United States Patent [19]

Reichelt et al.

[11] Patent Number: 5,060,713

[45] Date of Patent: Oct. 29, 1991

[54] METHOD OF AND APPARATUS FOR SPRAYCASTING

[75] Inventors: Wolfgang Reichelt, Moers; Peter Voss-Spilker, Kempen; Ulrich Urlau, Moers; Franz Keutgen, Lissendorf; Erich Willems, Oberstadtfeld, all of Fed. Rep. of Germany

[73] Assignee: Mannesmann AG, Duesseldorf, Fed. Rep. of Germany

[21] Appl. No.: 474,283

[22] Filed: Feb. 5, 1990

[30] Foreign Application Priority Data

Feb. 3, 1989 [DE] Fed. Rep. of Germany ..... 3903597
Feb. 23, 1989 [DE] Fed. Rep. of Germany ..... 3905873

[51] Int. Cl.[5] ..... B22D 23/00

[52] U.S. Cl. ..... 164/46; 164/441; 164/447; 164/459; 164/484

[58] Field of Search ..... 164/46, 459, 484, 441, 164/447

[56] References Cited

U.S. PATENT DOCUMENTS 3,290,734 12/1966 Wertli ..... 164/441
3,563,297 2/1971 Wertli ..... 164/484
3,894,577 7/1975 Milyaev et al. ..... 164/441
4,592,408 6/1986 Haissig ..... 164/441 X
4,697,631 10/1987 Bungeroth et al. ..... 164/46
4,911,221 3/1990 Jordan et al. ..... 164/46 X
4,911,224 3/1990 Keutgen et al. ..... 164/484 X

FOREIGN PATENT DOCUMENTS 569367 11/1957 Italy ..... 164/447
391898 12/1973 U.S.S.R. ..... 164/484

*Primary Examiner*—J. Reed Batten, Jr.
*Attorney, Agent, or Firm*—Nils H. Ljungman & Associates

[57] ABSTRACT

The apparatus includes a spray chamber having a transport device for positioning a billet adjacent a nozzle for spraying a stream of molten metal onto the surface of the billet. The billet is engaged by a tandem arrangement of holding devices which are attached to driven ring gears. With the holding devices engaging the billet rotation of the ring gears rotates the billet about its longitudinal axis as the billet is sprayed with molten metal from the nozzle. As the billet is rotated it is also moved longitudinally by servo-cylinders attached to the ring gears. The servo-cylinders advance and retract in sequence as the ring gears rotate to generate combined longitudinal and rotational movement of the billet adjacent the nozzle. Thus a uniform layer of metal is deposited over length of the billet to form a round billet exclusively by spray-casting.

16 Claims, 3 Drawing Sheets

METHOD OF AND APPARATUS FOR SPRAYCASTING

BACKGROUND OF THE INVENTION

1. Field of the Invention:

This invention relates to the shaping of steel ingots and, more particularly, to a method and associated apparatus for properly moving steel billets through a spray machine in order to shape the billets.

2. Background Information:

Apparatus for spray-casting and compaction of metal is known. A substrate, for example, a billet is sprayed with molten metal, and the metal particles are deposited on the billet to form a layer of coherent metal. The surface of the spray cast deposit is then shaped by suitable means. European Patent Application No. 02 25 732 discloses a horizontal spray installation where the product is radially positioned relative to movable or adjustable bearings. European Patent Application No. 01 88 994 discloses different apparatus for forming a continuous length of unsupported coherent metal by metal spray deposition whereby form shaping walls are located in a cage. The cage, in turn, is located in a housing which may rotate and move in a longitudinal manner. This arrangement eliminates special supports for the block or ingot which is being produced by spray compacting.

OBJECTS OF THE INVENTION

It is an object of the invention to provide a method and apparatus for producing rotationally symmetric metal spray compacted products, specifically round billets, wherein the products are maintained in a desired position during the metal spray procedure. Additionally, it is a further object to provide reliable longitudinal and rotational movement of the product during spraying.

SUMMARY OF THE INVENTION

The present invention provides a special advantage in that a very compact facility, or equipment arrangement, is provided. Further, the present invention provides the required rotary motion for the delivery of the head of the created product as it is fed through the facility. An additional advantage of the present invention is the arrangement of the apparatus to provide longitudinal movement of the head of the created product without the need for additional equipment requirements. A further advantage is that rotationally symmetric products can be manufactured which can be subdivided into desired partial lengths.

One aspect of the invention resides broadly in a method for spray compaction of a form comprising the steps; a) providing a form to be spray compacted; b) providing spray compacting apparatus; c) providing first apparatus for moving the form adjacent the spray compacting apparatus, the first apparatus being movable in a first direction from a first position to a second position and being movable in a second direction from the second position to the first position with the second direction being opposite the first direction; d) providing second apparatus for moving the form adjacent the spray compacting apparatus, the second apparatus being movable in a first direction from a third position to a fourth position and being movable in a second direction from a fourth position to a third position; e) moving the second apparatus from the fourth position to the third position; f) spray compacting the form by moving the form adjacent to the spray compacting in the first direction by the first apparatus moving from the first position to the second position; g) moving the first apparatus from the second position to the first position; h) spray compacting the form by moving the form adjacent to the spray compacting apparatus in the first direction by the second apparatus moving from the third position to the fourth position; and i) repeating steps e, f, g and h until the form is spray compacted.

Another aspect of the invention resides broadly in an apparatus for spray compaction of a form comprising a spray compacting apparatus in which a first device for moving the form is adjacent to the spray compacting apparatus. The first device is movable in the first direction from a first position to a second position. The first device is movable in a second direction from the second position to the first position. The second direction is opposite the first direction. The second device is for moving the form adjacent to the spray compacting apparatus. The second device is movable in the first direction from a third position to a fourth position. The second device is movable in the second direction from the fourth position to the third position.

BRIEF DESCRIPTION OF THE DRAWINGS

The following Description of the Preferred Embodiment may be better understood when taken in conjunction with the appended drawings in which.

DESCRIPTION OF THE PREFERRED EMBODIMENT

Figure 1:
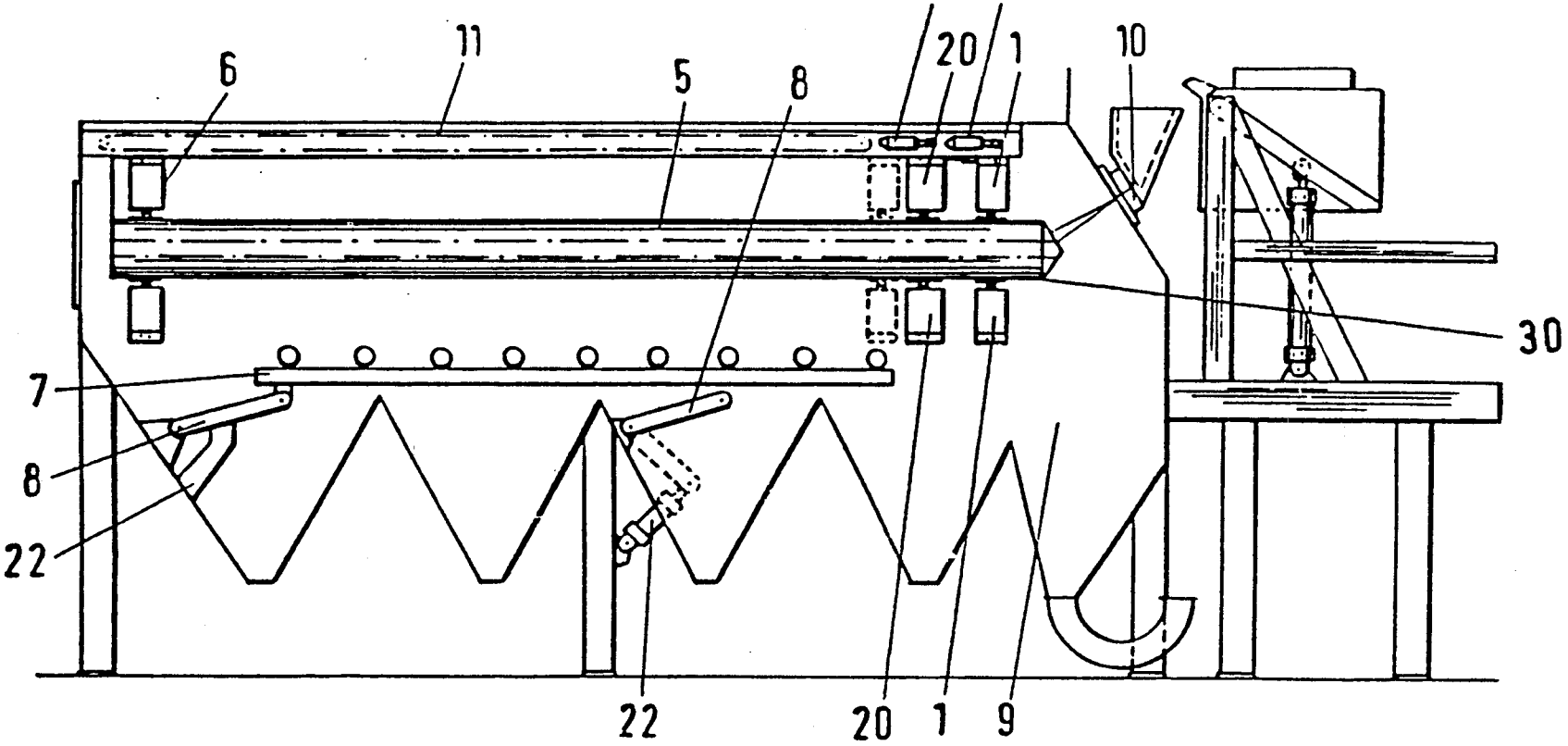
FIG. 1 is a side elevational view, partially in section, of a spray chamber employing the present invention.

The present invention includes spray chamber 9 which has beveled or slanted surface for the reception of spray nozzle 10. Spray nozzle 10, preferably, sprays liquid molten metal at an angle of 35°, relative to the horizonal, although other angular orientations may also be acceptable. Details of the nozzle arrangement are not discussed, herein, since they are well known to those of ordinary skill in the art as disclosed in U.S. Pat. No. 4,697,631 entitled "Process For The Production Of An Ingot" which is assigned to the same assignee as the instant application. With this known device a stream of molten metal flows from a tank into a spray nozzle and is sprayed by pressurized gas resulting in a spray jet which is caught on the surface of a dummy bar to form an ingot.

Transport device 7 is positioned in the lower half of chamber 9. Transport device 7 can be moved in contact with billet 5 by means of lever 8 and hydraulic apparatus 22. Transport device 7 is used to remove finished billet 5 from spray chamber 9.

Holders 1 and 20, as well as support devices 6, hold delivery or head portion 30 of the manufactured billet in a definable position, while also enabling the rotation and longitudinal movement of portion relative to spray nozzle 10.

Figure 2:
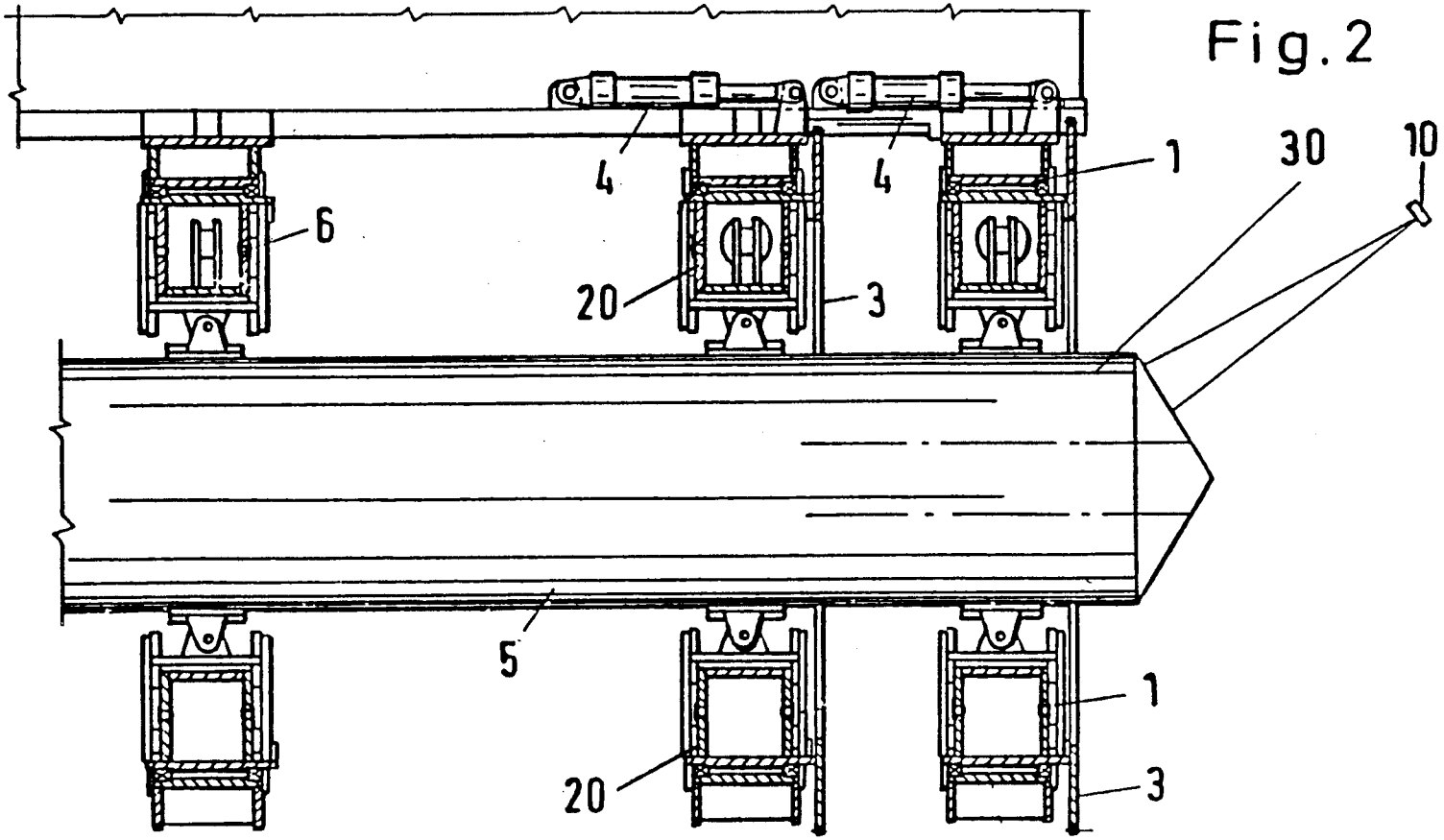
FIG. 2 is a side elevational view, partially in section, of a portion of the apparatus of FIG. 1.
Figure 3:
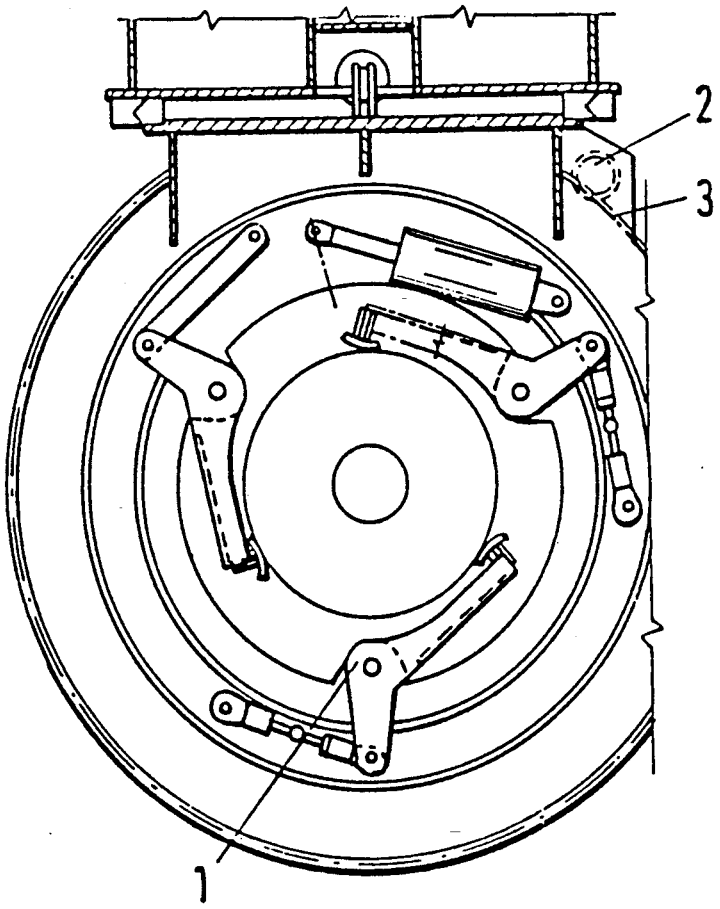
FIG. 3 is a partial end view of the apparatus of FIGS. 1 and 2.

Holders 1 and 20 are attached to coaxial ring gears 3. Ring gears 3 surround delivery or head portion 30 of billet 5. Holders 1 and 20 can be swivelled so that a radial adjustment to the delivery or head portion of billet 5, with the help of cylinder 4, is possible. Ring gears 3, along with holders 1 and 20, can rotate around the delivery or head portion of billet 5. Common pinions 2 are utilized to facilitate such rotation. Holders 1 and 20 are mounted in tandem, as shown in FIG. 2, and may be identical. Additionally, servo-cylinders 4 may be attached to ring gears 3 or holders 1 and 20. Servo-cylinders 4 are braced on one side and move holders 1 and 20 back and forth along the longitudinal direction of billet 5, toward and away from spray nozzle 10. Holders 1 and 20 may also be designed to rotate billet 5 while billet 5 is being moved longitudinally.

During the beginning of the spray cycle, for spray compacting billet 5, head portion 30 of billet 5 is first moved by holders 1 and 20 into a predetermined position, relative to nozzle 10, so that, initially, the material, or liquid molten metal, ejected from nozzle 10 hits head portion 30. Then, a continuous longitudinal and rotational movement of billet 5 is made adjacent nozzle 10. Gradually, therefore, a round billet is formed by spray-casting, as shown in FIG. 2.

In order to maintain the billet in a predetermined position towards the nozzle and, also, to make possible rotational and longitudinal movement, holders 1 and 20 alternately act to move billet 5. Holders 1 and 20 are circumferentially arranged in an offset manner to hold billet 5 in the proper line of movement in its longitudinal direction by servo-cylinders 4. Simultaneously, as billet 5 is longitudinally moved by holder 1, one rotation of ring 3 and pinion gear 2 occurs. Holder 20 is returned to the starting position as indicated by the dotted lines in FIG. 1 and, if the holder 1 is located in its furthermost position, can continue the further removal and rotation of billet 5 while holder 1 is moved back into the front position.

Holder 1 moves billet 5 in its longitudinal direction. When holder 1 reaches its farthest position, holder 20 then continues to move billet 5 in the same direction while holder 1 moves back to its initial position. Holder 1 then takes over to continue to move billet 5 in the same direction while holder 20 returns to its initial position and waits until holder 1 reaches, again, its farthest position. Holder 20 then, again, takes over to move billet 5. This continues, alternately, until the entire billet 5 has been sprayed with molten metal by nozzle 10 to deposit a layer of metal particles on the initial billet to form the finished billet. The metal deposits are firmly interlocked with the initial billet to form the finished billet. Movement of the holder 1 back to its initial position may take place simultaneously with or before or after holder 20 moves billet 5 longitudinally. Likewise, movement of holder 20 back to its initial position may take place simultaneously with or before or after holder 1 moves billet 5 longitudinally.

Support arrangement 6 is clamped onto, and holds, round billet 5. However, support 6 does not move billet 5 either linearly or rotationally. Support 6 may be moved by billet 5 as billet 5 is moved linearly and rotationally. Pulley 11 may be fastened in the upper part of the spray chamber and can serve to assist in moving support 6 back to its initial position after being moved by billet 5.

Servo-cylinders 4 may be provided with hydraulic pressure in a manner well known to those skilled in the art. A patent that discloses apparatus for providing hydraulic pressure to cylinders is U.S. Patent No. 4,696,651.

Patents relating to forming billets and ingots include U.S. Pat. No. 4,697,631, entitled "Process For The Production Of An Ingot"; U.S. Pat. No. 4,019,560, entitled "Spray Cooling Of Continuously Cast Ingots"; U.S. Pat. No. 4,136,527, entitled "Cooling Continuously Cast Ingots"; U.S. Pat. No. 4,509,580, entitled "Bottom Block"; and U.S. Pat. No. 4,546,816, entitled "Method And Apparatus Of Continuously Casting Hollow Round Billets With A Hypocycloidal Mandrel And An Inside Rolling Process."

In summary, one feature of the invention resides broadly in an apparatus for horizontal spray-casting or spray compaction of rotationally symmetric products consisting of a spray chamber, attached to which is a nozzle for the spray jet or atomized stream of molten metal as well as supportive holders which make longitudinal movement possible for the radially adjustable head or manufacturer product respectively, as well as a facility for the simultaneously turning of the head or product respectively around its longitudinal axis, is characterized by the fact that several holders 1 and 20 are located in a axial distance behind each other and around the circumference of the head of the manufactured products 5. Holders 1 and 20 are attached in a hinged fashion to coaxial ring gears 3 which are driven by a common pinion and servo-cylinders 4 engage in ring gear 3. Servo-cylinder 4 moves ring gear 3 and with that the corresponding holder 1 interchangeably parallel to the longitudinal axis of the head or product 5 respectively, whereby the forward movement of the head or the product respectively becomes clamped while on the return movement holders 1 and 20 are disengaged from the head or manufactured products respectively.

Another feature of the invention resides broadly in the apparatus which is characterized by the fact that in an axial distance behind holders 1 and 20, there is at least one support device 6 for the manufactured product which likewise shows on these adjustable holders.

Yet another feature of the invention resides broadly in an apparatus which is characterized by the fact that a movable or transport facility 7 for the removal of the manufactured products from spray chamber 9 is provided within the spray chamber 9 below holders 1 and 20 and support device 6.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirely herein.

The invention as described hereinabove in the context of the preferred embodiment is not to be taken as limited to all of the provided details thereof, since modification and variations thereof may be made without departing from the spirit and scope of the invention.

What is claimed is:

1. Method for spray compaction of a form comprising the steps of:

a) providing a form to be spray compacted;

b) providing spray compacting means for spray-casting said form with liquid metal;

c) providing first means for moving said form adjacent said spray compacting means, said first means being movable in a first direction from a first position to a second position, said first means being movable in a second direction from said second position to said first position, said second direction being opposite said first direction;

d) providing second means for moving said form adjacent said spray compacting means, said second means being movable in said first direction from a third position to a fourth position, said second means being movable in said second direction from said fourth position to said third position;

e) moving said second means from said fourth position to said third position;

f) spray compacting said form solely by moving said form adjacent said spray compacting means in said first direction by said first means moving from said first position to said second position while axially rotating said form;

g) moving said first means from said second position to said first position;

h) spray compacting said form solely by moving said form adjacent said spray compacting means in said first direction by said second means moving from said third position to said fourth position while axially rotating said form; and i) repeating steps e, f, g and h until said form is spray compacted.

2. The method of claim 1, wherein:

said first means is configured to be engaged with said form when said first means moves in said first direction; and said first means is configured to be disengaged from said form when said first means moves in said second direction.

3. The method of claim 2, wherein:

said second means is configured to be engaged with said form when said second means moves in said first direction; and said second means is configured to be disengaged from said form when said second means moves in said second direction.

4. The method of claim 3, wherein:

said first means and said second means are relatively positioned to define a linear axis: and said form is moved along said linear axis by said first means and said second means.

5. The method of claim 1, wherein:

said first means includes third means for being engaged with and disengaged from said form;

said third means is configured to assume a first engaging position when being engaged with said form;

said third means is configured to assume a first disengaging position when disengaged from said form; and said third means is moved between said first engaged position and said first disengaged position by hydraulic piston and cylinder means.

6. The method of claim 5, wherein:

said second means includes fourth means for being engaged with and disengaged from said form;

said fourth means is configured to assume second engaging position when being engaged with said form:

said fourth means is configured to assume a second disengaging position when disengaged from said form; and said fourth means is moved between said second engaged position and said second disengaged position by hydraulic piston and cylinder means.

7. The method of claim 6, further including the steps of:

providing holder means along said linear axis: and holding said form with said holder means.

8. The method of claim 7, further including the steps of:

providing moving means for moving said form out of adjacency of said spray compacting means; and moving said form out of adjacency of said spray compacting means.

9. The method of claim 1, wherein:

said steps e and f are performed simultaneously; and said steps g and h are performed simultaneously.

10. Apparatus for spray compaction of a form comprising:

spray compacting means for spray-casting a form with liquid metal;

first means for longitudinally moving and axially rotating said form adjacent said spray compacting means, said first means being movable in a first direction from a first position to a second position to longitudinally move said form as said form rotates and liquid metal is sprayed onto the surface of said form, said first means being movable in a second direction from said second position to said first position, said second direction being substantially opposite said first direction; and second means for longitudinally moving and axially rotating said form adjacent said spray compacting means, said second means being movable in said first direction from a third position to a fourth position to longitudinally move the form as said form rotates and liquid metal is sprayed onto the surface of said form, said second means being movable in said second direction from said fourth position to said third position.

11. The apparatus cf claim 10, wherein:

said first means is configured to be engaged with said form when said first means moves in said first direction; and said first means is configured to be disengaged from said form when said first means moves in said second direction.

12. The apparatus of claim 11, wherein:

said second means is configured to be engaged with said form when said second means moves in said first direction; and said second means is configured to be disengaged from said form when said second means moves in said second direction.

13. The apparatus of claim 12, wherein:

said first means and said second means are relatively positioned to define a linear axis; and said form is moved along said linear axis by said first means and said second means.

14. The apparatus of claim 13, wherein:

said first means includes third means for being engaged with and disengaged from said form;

said third means is configured to assume a first engaging position when being engaged with said form;

said third means is configured to assume a first disengaging position when disengaged from said form; and said third means is moved between said first engaged position and said first disengaged position by hydraulic piston and cylinder means.

15. The apparatus of claim 14, wherein:

said second means includes fourth means for being engaged with and disengaged from said form;

said fourth means is configured to assume a second engaging position when being engaged with said form;

said fourth means is configured to assume a second disengaging position when disengaged from said form; and said fourth means is moved between said second engaged position and said second disengaged position by hydraulic piston and cylinder means.

16. The apparatus cf claim 15, further including:

holder means positioned along said linear axis for holding said form; and moving means for moving said form out of adjacency with said spray compacting means.

* * * * *

UNITED STATES PATENT AND TRADEMARK OFFICE

CERTIFICATE OF CORRECTION

PATENT NO. : 5,060,713

DATED : October 29, 1991

INVENTOR(S) : Wolfgang REICHELT et al.

It is certified that error appears in the above-identified patent and that said Letters Patent is hereby corrected as shown below:

Title page, item [54], delete "SPRAYCASTING" and insert --SPRAY CASTING--.

Title page, item [73] Assignee: delete "Duesseldorf" and insert --Dusseldorf--.

In column 1, line 3, delete "SPRAYCASTING" and insert --SPRAY CASTING--.

Col. 5, claim 4, line 3, delete "axis:" and insert --axis;--.

UNITED STATES PATENT AND TRADEMARK OFFICE

CERTIFICATE OF CORRECTION

PATENT NO. : 5,060,713

DATED : October 29, 1991

INVENTOR(S) : Wolfgang REICHELT et al.

It is certified that error appears in the above-identified patent and that said Letters Patent is hereby corrected as shown below:

Col. 5, claim 6, line 6, delete "form:" and insert --form;--.

Col. 6, claim 7, line 1, delete "axis:" and insert --axis;--.

Col. 6, claim 14, line 1, delete "13," and insert --10,--.

Signed and Sealed this

Twentieth Day of April, 1993

*Attest:*

*Attesting Officer*

MICHAEL K. KIRK

*Acting Commissioner of Patents and Trademarks*